US009620916B2

(12) United States Patent
Healy

(10) Patent No.: US 9,620,916 B2
(45) Date of Patent: Apr. 11, 2017

(54) SUPPORT DEVICE FOR ELECTRIFIED INSERT

(71) Applicant: Visual Graphic Systems Inc., Carlstadt, NJ (US)

(72) Inventor: Donall B. Healy, New York, NY (US)

(73) Assignee: VISUAL GRAPHIC SYSTEMS INC., Carlstadt, NJ (US)

( * ) Notice: Subject to any disclaimer, the term of this patent is extended or adjusted under 35 U.S.C. 154(b) by 0 days.

(21) Appl. No.: 14/612,981

(22) Filed: Feb. 3, 2015

(65) Prior Publication Data

US 2015/0147897 A1 May 28, 2015

Related U.S. Application Data

(63) Continuation of application No. 12/305,472, filed as application No. PCT/US2007/072933 on Jul. 6, 2007, now Pat. No. 8,959,811.

(60) Provisional application No. 60/819,854, filed on Jul. 10, 2006.

(51) Int. Cl.

| | |
|---|---|
| ***G09F 13/00*** | (2006.01) |
| ***H01R 25/14*** | (2006.01) |
| ***G09F 7/18*** | (2006.01) |
| ***G09F 13/18*** | (2006.01) |
| ***G09F 13/22*** | (2006.01) |
| ***H01R 4/64*** | (2006.01) |
| *G09F 13/28* | (2006.01) |
| *H01R 9/22* | (2006.01) |

(52) U.S. Cl.

CPC ..... *H01R 25/145* (2013.01); *G09F 7/18* (2013.01); *G09F 13/18* (2013.01); *G09F 13/22* (2013.01); *H01R 4/64* (2013.01); *G09F 13/00* (2013.01); *G09F 13/28* (2013.01); *H01R 9/226* (2013.01)

(58) Field of Classification Search

CPC ..... G09F 13/00; G09F 13/28; G09F 13/22
USPC ..... 40/541, 551, 581, 546, 617, 544; 439/271–277; 362/404

See application file for complete search history.

(56) References Cited

U.S. PATENT DOCUMENTS

| | | | | |
|---|---|---|---|---|
| 4,949,487 | A * | 8/1990 | Kibarer | 40/551 |
| 7,033,192 | B2 * | 4/2006 | Hansen | 439/181 |
| 2007/0199222 | A1 * | 8/2007 | Turner | G09F 15/0037 40/607.02 |

* cited by examiner

*Primary Examiner* — Syed A Islam
(74) *Attorney, Agent, or Firm* — Leason Ellis LLP

(57) ABSTRACT

A holder for supporting electrified inserts that may vary in width, comprises a base having a groove into which the insert can be placed. Two or more gaskets can be positioned in the groove with each gasket including a resilient section adapted to engage the insert so as to retain the insert securely in place within the groove. Each of the gaskets also includes an electrical conductor, such as an electrical wire, which may be embedded in the gasket, in a position where it makes electrical contact with the electrical terminals on the insert.

14 Claims, 1 Drawing Sheet

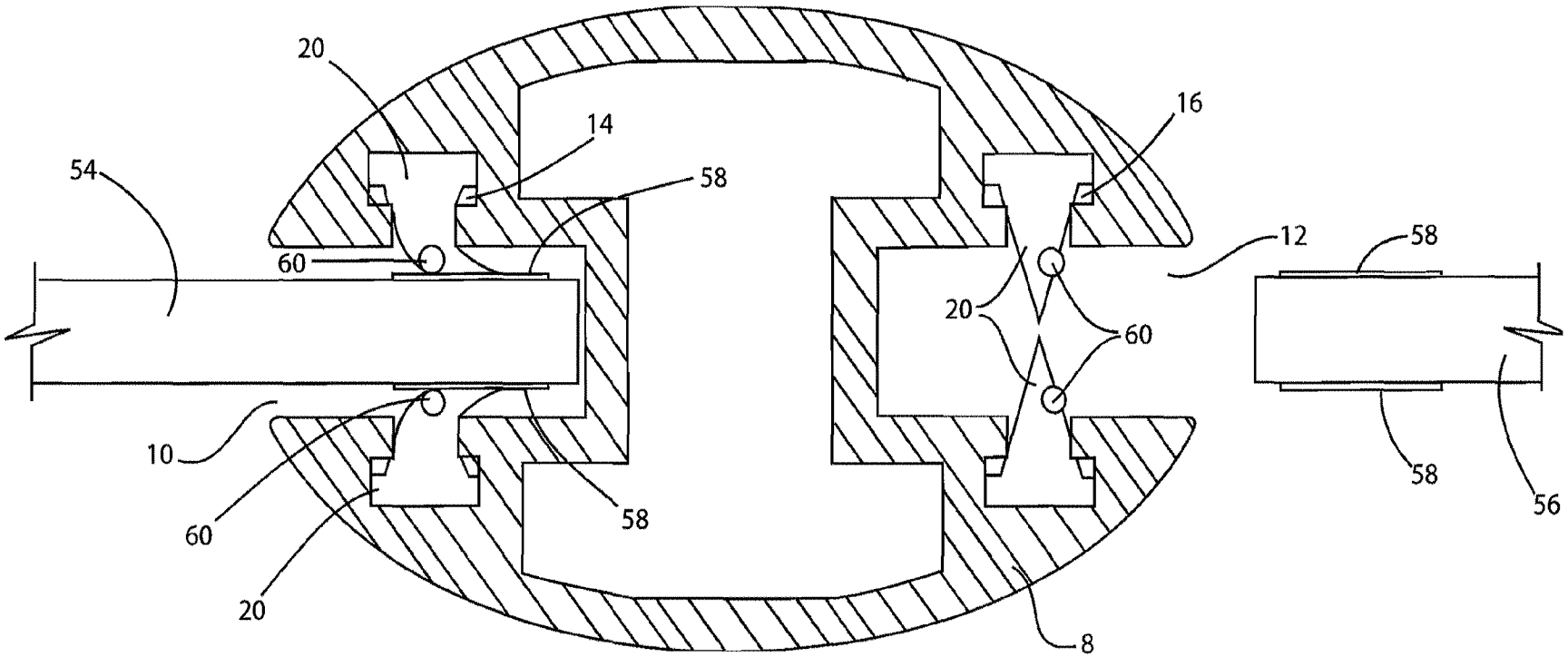
56
58
58
12
16
60
8
20
58
58
14
20
60
60
20
10
54

SUPPORT DEVICE FOR ELECTRIFIED INSERT

CROSS-REFERENCE TO PRIOR APPLICATION

This application is a continuation of U.S. patent application Ser. No. 12/305,472, filed Dec. 18, 2008, now allowed, which is a U.S. National Phase Application under 35 U.S.C. §371 of International Patent Application No. PCT/US07/072933, filed on Jul. 6, 2007, and claims benefit of U.S. Provisional Application No. 60/819,854, filed on Jul. 10, 2006 all of which are hereby incorporated be reference in the entireties.

FIELD OF THE INVENTION

This invention relates to a device for holding signs. More particularly, this invention relates to a device for holding electrified sign inserts, and is of particular utility for use with sign inserts which need to be changed or updated on a relatively frequent basis.

BACKGROUND OF THE INVENTION

U.S. provisional application Ser. No. 60/776,341 entitled "Display Support Device" and filed on Feb. 24, 2006 discloses a display support device comprising an extruded base having one or more slots into which replaceable sign inserts can be placed. The extruded base includes at least one rubber gasket in each groove so that the sign inserts can be firmly secured despite substantial variations in the thickness of the sign insert. Provisional Application Ser. No. 60/776,341 is hereby incorporated by reference into this application.

The present invention incorporates the rubber gaskets of the '341 provisional application as a means for supporting sign inserts which are intended to be illuminated. For example, the invention may be used with electroluminescent signs, organic LED sheets, and edge lit signs all of which are known to those familiar with the signage arts.

The invention provides a sign holder of the type described wherein signs that vary in thickness can be tightly retained without resort to supplemental fastening means such as adhesives, mechanical fasteners, shims or the like, and wherein means are provided for coupling electrical power to the sign insert.

SUMMARY OF THE INVENTION

The invention comprises a sign holder for supporting a sign insert containing electrical terminals which enable a source of electrical energy to be applied to the sign insert. The holder includes a base and a groove in the base for receiving the sign insert. At least one resilient gasket, preferably two, is positioned in the groove and adapted to engage the sign insert so as to retain the insert securely in place within the groove despite thickness variations between different sign inserts. At least one electrical conductor is attached to the gasket in a position where it makes electrical contact with the electrical terminal on the sign insert when the sign insert is placed in the groove.

THE DRAWING

FIG. 1 is a cross sectional view of a sign holder in accordance with a preferred embodiment of the invention.

DETAILED DESCRIPTION

In the preferred embodiment of the invention as shown in FIG. 1, the sign holder comprises an extruded base 8. The extrusion may be metallic, for example aluminum, or a suitable plastic material such as polyvinylchloride. In FIG. 1 the extruded base 8 is generally oval shaped and includes opposing grooves 10 and 12.

In the illustrated embodiment, grooves 10 and 12 include two T-shaped slots 14 and 16, respectively, which are formed during extrusion of the holder 8. Complementary T-shaped gaskets 18 and 20 are positioned within the grooves 14 and 16, respectively. The gaskets 14 and 16 are made of a resilient material, such as rubber, and may be extruded with a tapered extension (similar to a wiper blade) that extends into the grooves 10 and 12.

The sign holder 8 shown in FIG. 1, by way of example, may be supported so that it extends vertically, i.e., the cross section of FIG. 1 is a horizontal cross section. Sign inserts 54 and 56 can be inserted into the grooves 10 and 12, respectively. When the edge of a sign insert is inserted into one of the grooves, the resilient tips of the rubber gaskets in that groove are deflected to accommodate the insert but the resistance is such that the insert is held securely in place regardless of normal variations in the thickness of the sign inserts. The resistance, however, can be overcome by applying a force to the sign insert to pull it from the groove or by sliding it to one side so that it can be removed and replaced by another insert.

The gaskets 18 and 20 are inserted into the T-shaped grooves 14 and 16 by sliding. The use of a lubricant such as talcum powder facilitates insertion.

As indicated above, the invention can be used with different types of electrified signs. For example, if the sign inserts 54 and 56 are electroluminescent signs or organic LED's, the sign inserts may include copper or other electrical terminals 58 on opposite sides of each sign insert. Each of the gaskets 18 and 20 includes an embedded conductor (e.g., copper) 60 on its outwardly facing surface. When the sign inserts 54 and 56 are inserted into the grooves 10 and 12, contact is made between the embedded wires 60 and the terminals 58. Thus, by applying a voltage to the embedded wires 60, the voltage can be applied across the sign inserts 54 and 56 to illuminate the sign or part of the sign.

The terminals 58 may be secured to the associated sign insert 54 or 56 by suitable adhesives, but the specific way in which the contact is attached to the insert is not a feature of the invention. Likewise, the wires 60 may be embedded within the material of the gaskets 18 and 20 but other methods of fixation may also be used.

Although the invention was designed for the purpose of supporting illuminated panel light sign inserts, the invention could also be used to support light sources which do not function as signage.

The invention claimed is:

1. A holder for supporting one of multiple inserts having front and rear exterior surfaces wherein the holder receives any one of a plurality of inserts each having differing distances between said surfaces, each said insert containing electrical terminals parallel to, and attached to, at least one of said exterior surfaces for enabling the supply of electrical power to the insert, comprising:

a base, a groove in the base for receiving the insert, at least one non-conductive gasket positioned in the groove, said gasket including a non-conductive resilient section adapted to engage at least one of said exterior surfaces of the insert for retaining the insert securely in place within the groove, and at least one electrical conductor embedded at least partially in the non-conductive resilient section of the gasket in a position where it makes electrical contact with one of the electrical terminals on the insert, when the insert is placed in the groove.

2. A holder according to claim 1, wherein at least two gaskets are positioned in said groove, said gaskets adapted to engage said front and rear exterior surfaces on opposite sides of said insert, and wherein each gasket includes an electrical conductor for engaging one of said electrical terminals on the insert when the insert is placed in the groove.

3. A holder according to claim 2, wherein said electrical conductors are embedded in said gaskets.

4. In combination, a holder and one of multiple different electrified inserts, said insert having front and rear exterior surfaces, wherein the holder receives any one of a plurality of inserts each having differing distances between said surfaces, each said insert including electrical terminals parallel to, and attached to, said front and rear exterior surfaces for enabling a supply of electrical power to be applied to the insert, said holder comprising:

a base, a groove in the base for receiving the insert, at least one non-conductive gasket positioned in the groove, said gasket including a non-conductive resilient section adapted to engage at least one of said front and rear exterior surfaces of the insert so as to retain the insert securely in place within the groove, and at least one electrical conductor embedded at least partially in the non-conductive resilient section of the gasket in a position where it makes electrical contact with one of the electrical terminals on the insert when the insert is placed in said groove.

5. The combination of a holder and insert according to claim 4, wherein at least two gaskets are positioned in said groove, said gaskets adapted to engage said front and rear exterior surfaces on opposite sides of said insert, and wherein each gasket includes an electrical conductor for engaging an electrical terminal on said insert when said insert is placed in said groove.

6. The combination of a holder and insert according to claim 5, wherein said electrical conductors are embedded in said gaskets.

7. The combination of a holder and insert according to claim 5, wherein said base comprises an elongated extruded member and wherein said groove includes a slot which opens into the groove, said gaskets being retained within said slots.

8. The combination of a holder and insert according to claim 6, wherein said base comprises an elongated extruded member and wherein said groove includes a slot which opens into the groove, said gaskets being retained within said slots.

9. The combination of a holder and insert according to claim 4, wherein said at least one electrical conductor embedded in said gasket comprises copper.

10. The combination of a holder and insert according to claim 4, wherein said base comprises an elongated extruded member and wherein said groove includes a slot which opens into the groove, said at least one gasket being retained within said slot.

11. A holder according to claim 1, wherein said at least one electrical conductor embedded in said gasket comprises copper.

12. A holder according to claim 1, wherein said base comprises an elongated extruded member and wherein said groove includes a slot which opens into the groove, said gasket being retained within said slot.

13. A holder for supporting one of multiple inserts having front and rear exterior surfaces on opposite sides of the insert wherein the holder receives any one of a plurality of inserts each having differing distances between said surfaces, each said insert containing electrical terminals parallel to, and attached to, at least one of said exterior surfaces for enabling the supply of electrical power to the insert, comprising: a base, a groove in the base for receiving the insert, at least one pair of non-conductive gaskets positioned complementary to one another in the groove, said gaskets each including a non-conductive resilient section adapted to retain the insert securely in place within the groove, the non-conductive resilient section of a first gasket of the at least one pair of gaskets being adapted to engage said front exterior surface of the insert and the non-conductive resilient section of a second gasket of the at least one pair of gaskets being adapted to engage said rear exterior surface of the insert, and at least one electrical conductor attached to each of the at least one pair of gaskets in a position where each electrical conductor makes electrical contact with each of the electrical terminals on the insert, when the insert is placed in the groove, wherein said at least one electrical conductor is attached as an embedded conductor in said gasket.

14. A holder according to claim 13, wherein said at least one electrical conductor attached as an embedded conductor in said gasket comprises copper.

* * * * *